United States Patent [19]

von Rybinski et al.

[11] Patent Number: 4,789,466

[45] Date of Patent: Dec. 6, 1988

[54] METHOD OF SEPARATING NON-SULFIDIC MINERALS BY FLOTATION

[75] Inventors: Wolfgang von Rybinski, Duesseldorf; Rita Koester, Neuss, both of Fed. Rep. of Germany

[73] Assignee: Henkel Kommanditgesellschaft auf Aktien, Duesseldorf, Fed. Rep. of Germany

[21] Appl. No.: 861,672

[22] Filed: May 9, 1986

[30] Foreign Application Priority Data

May 11, 1985 [DE] Fed. Rep. of Germany ..... 3517154

[51] Int. Cl.[4] ..... B03D 1/02

[52] U.S. Cl. ..... 209/166; 252/DIG. 1; 252/61

[58] Field of Search ..... 209/166, 167; 252/61, 252/DIG. 1

[56] References Cited

U.S. PATENT DOCUMENTS

| | | | |
|---|---|---|---|
| 2,302,338 | 11/1942 | Moeller | 209/166 |
| 2,611,485 | 9/1952 | Tueter | 209/166 |
| 3,595,390 | 7/1971 | Booth | 209/166 |
| 4,090,972 | 5/1978 | Wang et al. | 252/61 |
| 4,211,644 | 7/1980 | Wiechers | 209/166 |
| 4,309,282 | 1/1982 | Smith | 209/166 |
| 4,358,368 | 11/1982 | Hellsten et al. | 209/166 |
| 4,457,850 | 7/1984 | Tesmann et al. | 252/61 |
| 4,594,151 | 6/1986 | Delourve | 209/166 |
| 4,852,596 | 4/1986 | Hansen | 209/166 |

FOREIGN PATENT DOCUMENTS

| | | | |
|---|---|---|---|
| 2547987 | 5/1976 | Fed. Rep. of Germany . | |
| 64275 | 10/1968 | German Democratic Rep. . | |
| 668710 | 6/1979 | U.S.S.R. | 209/166 |
| 986504 | 1/1983 | U.S.S.R. | 209/166 |
| 1138189 | 7/1983 | U.S.S.R. | 209/166 |
| 2163976 | 3/1986 | United Kingdom | 252/61 |

OTHER PUBLICATIONS

Kirk Othmer Encyclopedia of Chemical Technology, 3rd Ed., vol. 22, pp. 376'4 377, copy. 1980, John Wiley & Sons.

Trans. Inst. Met. Min. Sect. C., 84 (1975), pp. 34–39.

Dev. Min. Proc. 2 (1979), pp. 86–109.

A. M. Gaudin Memorial Volume (1976), vol. I, pp. 597–620.

Aufbereitung Fester Mineralischer Rohstoffe, 2nd edition, Leipzig, 1977, pp. 310–311, by H. Schubert.

Int. J. Min. Proc., 9 (1982), pp. 353–384.

Colloid & Polymer Sci., 259 (1981), pp. 775–776.

Condensed Chemical Dictionary, sixth ed., Reinhold Publishing Corporation, New York, 1961, p. 906, entry "Pluronic".

*Primary Examiner*—Kenneth M. Schor

*Assistant Examiner*—Thomas M. Lithgow

*Attorney, Agent, or Firm*—Ernest G. Szoke; Henry E. Millson, Jr.; Wayne C. Jaeschke

[57] ABSTRACT

A process for separating non-sulfidic minerals from an ore by flotation in which the ore is contacted with a mixture of (a) at least one adduct of ethylene oxide and propylene oxide with a $C_8$–$C_{22}$ fatty alcohol and (b) at least one anionic, cationic or ampholytic surfactant.

16 Claims, No Drawings

METHOD OF SEPARATING NON-SULFIDIC MINERALS BY FLOTATION

BACKGROUND OF THE INVENTION

1. Field of the Invention

This invention relates to the use of mixtures of nonionic ethylene oxide/propylene oxide adducts and anionic or cationic surfactants which are known per se as collectors for flotation processes, as aids in the flotation of non-sulfidic ores.

2. Statement of Related Art

Flotation is a separation technique commonly used in the dressing of mineral raw materials for separating valuable minerals from those with no value. Non-sulfidic minerals are, for example, apatite, fluorite, scheelite and other salt-containing minerals, cassiterite and other metal oxides, such as oxides or titanium and zirconium, and also certain silicates and alumosilicates. For flotation, the ore is subjected to preliminary size-reduction, dry-ground or preferably wet-ground, and suspended in water. Collectors are normally added to the non-sulfidic ores, frequently in conjunction with frothers and, optionally, other auxiliary reagents such as regulators, depressors (deactivators) and/or activators, in order to facilitate separation of the valuable minerals from the unwanted gangue constituents of the ore in the subsequent flotation process. These reagents are normally allowed to act on the finely ground ore for a certain time (conditioning) before air is blown into the suspension (flotation) to produce a foam at its surface. The collector acts as a hydrophobicizing agent on the surface of the minerals, causing the minerals to adhere to the gas bubbles formed during the aeration step. The mineral constituents are selectively hydrophobicized so that the unwanted constituents of the ore do not adhere to the gas bubbles. The mineral-containing foam is stripped off and further processed. The object of flotation is to recover the valuable mineral in the ores in as high a yield as possible while at the same time obtaining a high enrichment level.

Anionic and cationic surfactants are used as collectors in known flotation processes for non-sulfidic ores. Known anionic collectors are, for example, saturated and unsaturated fatty acids, particularly tall oil fatty acids and oleic acid, alkyl sulfates, particularly alkyl sulfates derived from fatty alcohols or fatty alcohol mixtures, alkyl aryl sulfonates, alkyl sulfosuccinates, alkyl sulfosuccinamates and alkyl lactylates. Known cationic collectors are, for example, primary aliphatic amines, particularly the fatty amines derived from the fatty acids of vegetable and animal fats or oils, and also alkyl-substituted and hydroxyalkyl-substituted alkylene diamines and water-soluble acid addition salts of these amines.

By virtue of their surfactant character, many collectors for non-sulfidic minerals themselves develop a foam suitable for flotation. However, it may also be necessary to develop or suitably modify the foam by special frothers. Known flotation frothers are $C_4$–$C_{10}$ alcohols, polypropylene glycols, polyethylene glycol or polypropylene glycol ethers, terpene alcohols (pine oils) and cresyl acids. If necessary, modifying reagents, such as for example pH regulators, activators for the mineral to be recovered in the foam or deactivators for the unwanted minerals in the foam, or dispersants, are added to the flotation suspensions (pulps).

In contrast to anionic and cationic surfactants, nonionic surfactants are not often used as collectors in flotation. In Trans. Inst. Met. Min. Sect. C., 84 (1975), pp. 34–39, A. Doren, D. Vargas and J. Goldfarb report on flotation tests on quartz, cassiterite and chrysocolla which were carried out with an adduct of 9 to 10 moles of ethylene oxide with octyl phenol as collector. Combinations of ionic and nonionic surfactants are also occasionally described as collectors in the relevant literature. Thus, A. Doren, A. van Lierde and J. A. de Cuyper report in Dev. Min. Proc. 2 (1979), pp. 86–109 on flotation tests carried out on cassiterite with a combination of an adduct of 9 to 10 moles of ethylene oxide with octyl phenol and an octadecyl sulfosuccinate. In A. M. Gaudin Memorial Volume edited by M. C. Fuerstenau, AIME, New York, 1976, Vol. I, pp. 597–620, V. M. Lovell describes flotation tests carried out on apatite with a combination of tall oil fatty acid and nonyl phenyl tetraglycol ether.

Cationic, anionic and ampholytic collectors are used for the flotation of non-sulfidic ores. In many cases, collectors such as these used in economically reasonable quantities do not lead to satisfactory recovery of the valuable minerals. In order to make flotation processes more economical, it is desireable to find improved collectors with which it is possible to obtain either greater yields of valuable minerals for the same quantities of collector or the same yields of valuable minerals for reduced quantities of collector.

DESCRIPTION OF THE INVENTION

Accordingly, it is an object of the present invention to improve known collectors (primary collectors) for the flotation of non-sulfidic ores by suitable additives (co-collectors) to such an extent that the recovery of valuable minerals in the flotation process can be significantly increased for substantially the same collector selectivity, this effect also being used to obtain the same yields of valuable minerals for reduced amounts of collector and co-collector as compared with the prior art.

It has now been found that adducts of ethylene oxide and propylene oxide with $C_8$–$C_{22}$ fatty alcohols represent extremely effective additives as co-collectors to anionic, cationic or ampholytic surfactants of the type known as collectors for the flotation of non-sulfidic ores.

Other than in the operating examples, or where otherwise indicated, all numbers expressing quantities of ingredients or reaction conditions used herein are to be understood as modified in all instances by the term "about".

The present invention relates to a flotation process for separating non-sulfidic minerals from an ore wherein the ore is contacted with a mixture of (a) at least one adduct of ethylene oxide and propylene oxide with a $C_8$–$C_{22}$ fatty alcohol and (b) at least one anionic, cationic or ampholytic surfactant.

Component (a) consists in particular of adducts of m moles ethylene oxide and n moles propylene oxide with $C_8$–$C_{22}$ fatty alcohols, m and n each being a number of from 1 to 15, the sum of m and n being from 2 to 25 and the ratio of m to n being from 1:5 to 2:1. These ethylene oxide/propylene oxide adducts are known substances which may be synthesized by known processes. In general, they are obtained by addition of the intended quantities of ethylene oxide and propylene oxide with the fatty alcohols used as starting material in the presence of known alkaline alkoxylation catalysts. The addition of the alkylene oxides may be carried out either by reacting a corresponding mixture of ethylene oxide and propylene oxide with the fatty alcohol starting material or by addition of first one alkylene oxide and then the other. Products obtained by addition of ethylene oxide and subsequent reaction with propylene oxide are preferably used as component (a) in the mixtures used in accordance with the invention.

The fatty alcohol component of the ethylene oxide/propylene oxide adducts defined under (a) may consist of straight-chain and branched, saturated and unsaturated compounds of this category containing from 8 to 22 carbon atoms, for example of n-octanol, n-decanol, n-dodecanol, n-tetradecanol, n-hexadecanol, n-octadecanol, n-eicosanol, n-hexadecanol, isotridecanol and isooctadecanol. The fatty alcohols may individually form the basis of the ethylene oxide/propylene oxide adducts. In general, however, products based on fatty alcohol mixtures are used as component (a), these fatty alcohol mixtures being derived from the fatty acid component of fats and oils of animal or vegetable origin. It is known that fatty alcohol mixtures such as these may be obtained from the native fats and oils, inter alia by transesterification of the triglycerides with methanol and subsequent catalytic hydrogenation of the fatty acid methyl ester. It is possible to use both the fatty alcohol mixtures accumulating during production and also suitable fractions having a limited chainlength range as a basis for the addition of ethylene oxide and propylene oxide. In addition to the fatty alcohol mixtures obtained from natural fats and oils, synthetic fatty alcohol mixtures, as for example the known Ziegler and oxo fatty alcohols are suitable starting materials for the production of the ethylene oxide/propylene oxide adducts defined under (a). Adducts of ethylene oxide and propylene oxide with $C_{12}$–$C_{18}$ fatty alcohols are preferably used as component (a).

The polyalkylene glycol component of the above adducts preferably contains on a statistical average from 1 to 10 moles ethylene glycol units and from 1 to 15 moles propylene glycol units per mole fatty alcohol. The molar quantities are coordinated with one another in such a way that from 2 to 25 moles of alkylene glycol units are present per mole of fatty alcohol and that the molar ratio of ethylene glycol to propylene glycol units is in the range of from 1:5 to 2:1. Preferred products are those which contain from 2 to 6 ethylene glycol units and from 4 to 12 propylene glycol units per mole of fatty alcohol and in which the molar ratio of ethylene glycol units to propylene glycol units is in the range of from 1:1 to 1:2.

Anionic, cationic and ampholytic surfactants of the type known per se as collectors for the flotation of non-sulfidic ores can be used as component (b).

If anionic surfactants are to be used as component (b) in accordance with the invention, they are preferably selected from fatty acids, alkyl sulfates, alkyl sulfosuccinates, alkyl sulfosuccinamates, alkyl benzene sulfonates, alkyl sulfonates, petroleum sulfonates, alkyl sulfonates, petroleum sulfonates and acyl lactylates.

Suitable fatty acids include the straight-chain fatty acids containing from 12 to 18 carbon atoms and more especially from 16 to 18 carbon atoms obtained from vegetable or animal fats and oils, for example by lipolysis and, optionally, fractionation and/or separation by the hydrophilization process. Oleic acid and tall oil fatty acid are preferred.

Suitable alkyl sulfates include the sulfuric acid semiesters of $C_8$–$C_{22}$ fatty alcohols and preferably of $C_{12}$–$C_{18}$ fatty alcohols which may be linear or branched. The foregoing discussions of the fatty alcohol component of the ethylene oxide/propylene oxide adducts (component (a)) also apply to the fatty alcohol component of the sulfuric acid semiesters.

Suitable alkyl sulfosuccinates include sulfosuccinic acid semiesters of $C_8$–$C_{22}$ fatty alcohols and preferably of $C_{12}$–$C_{18}$ fatty alcohols. These alkyl sulfosuccinates may be obtained, for example, by reaction of corresponding fatty alcohols or fatty alcohol mixtures with maleic acid anhydride and subsequent addition of alkali metal sulfite or alkali metal hydrogen sulfite. The foregoing discussions of the fatty alcohol component of the ethylene oxide/propylene oxide adducts (component (a)) also apply to the fatty alcohol component of the sulfosuccinic acid esters.

The alkyl sulfosuccinamates which can be employed as component (b) correspond to the following formula

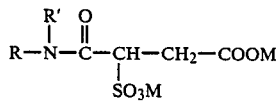

(I)

in which R is an alkyl or alkenyl group containing from 8 to 22 carbon atoms and preferably from 12 to 18 carbon atoms, R′ represents hydrogen or a $C_1$–$C_3$ alkyl group and M is a hydrogen ion, an alkali metal cation, e.g. sodium, potassium, lithium etc., or an ammonium ion, preferably a sodium or ammonium ion. The alkyl sulfosuccinamates corresponding to formula I are known substances obtained, for example, by reaction of corresponding primary or secondary amines with maleic acid anhydride and subsequent addition of alkali metal sulfite or alkali metal hydrogen sulfite. Examples of primary amines suitable for use in the preparation of the alkyl sulfosuccinamates are n-octyl amine, n-decyl amine, n-dodecyl amine, n-tetradecyl amine, n-hexadecyl amine, n-octadecyl amine, n-eicosyl amine, n-docosyl amine, n-hexadecenyl amine and n-octadecenyl amine. The above amines can individually form the basis of the alkyl sulfosuccinamates. However, amine mixtures of which the alkyl groups are derived from the fatty acid component of fats and oils of animal or vegetable origin are normally used for preparing the alkyl sulfosuccinamates. It is known that amine mixtures such as these may be obtained from the fatty acids of native fats and oils obtained by lipolysis via the corresponding nitriles by reduction with sodium and alcohols or by catalytic hydrogenation. Secondary amines suitable for use in the preparation of the alkyl sulfosuccinamates corresponding to formula I include the N-methyl and N-ethyl derivatives of the primary amines disclosed above.

Alkyl benzene sulfonates suitable for use as component (b) correspond to the following formula

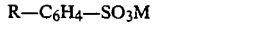

$$R—C_6H_4—SO_3M \quad \text{(II)}$$

in which R is a straight-chain or branched alkyl group containing from 4 to 16 and preferably from 8 to 12 carbon atoms and M is an alkali metal cation, e.g. sodium, potassium, lithium etc., or ammonium ion, preferably a sodium ion.

Alkyl sulfonates suitable for use as component (b) correspond to the following formula $$R-SO_3M \quad (III)$$

in which R is a straight-chain or branched alkyl group preferably containing from 8 to 22 carbon atoms, and more preferably, from 12 to 18 carbon atoms, and M is an alkali metal cation, e.g. sodium, potassium, lithium etc., or an ammonium ion, preferably a sodium ion.

The petroleum sulfonates suitable for use as component (b) are obtained from lubricating oil fractions, generally by sulfonation with sulfur trioxide or oleum. Those compounds in which most of the hydrocarbon radicals contain from 8 to 22 carbon atoms are particularly suitable.

The acyl lactylates suitable for use as component (b) correspond to the following formula $$R-\underset{\underset{O}{\|}}{C}-O-\underset{\underset{CH_3}{|}}{CH}-COOX \quad (IV)$$

in which R is an aliphatic, cycloaliphatic or alicyclic radical containing from 7 to 23 carbon atoms and X is a salt-forming cation, e.g. an alkali metal cation or an ammonium ion. R is preferably an aliphatic, linear or branched chain hydrocarbon radical which may be saturated, mono- or poly-unsaturated, e.g. olefinically unsaturated, and optionally substituted by one or more hydroxyl groups. The use of the acyl lactylates corresponding to formula IV as collectors in the flotation of non-sulfidic ores is described in German Patent Application P No. 32 38 060.7 (German Offenlegungsschrift No. 32 38 060).

If cationic surfactants are to be used as component (b) in accordance with the invention, they are preferably selected from primary aliphatic amines, from alkylene diamines substituted by α-branched alkyl groups or from hydroxyalkyl-substituted alkylene diamines and from water-soluble acid addition salts of these amines.

Suitable primary aliphatic amines are preferably the $C_8$–$C_{22}$ fatty amines derived from the fatty acids of native fats and oils which were discussed earlier in connection with the alkyl sulfosuccinamates also suitable for use as component (b). Mixtures of fatty amines are generally used, such as for example tallow amines or hydrotallow amines of the type obtainable from tallow fatty acids or from hydrogenated tallow fatty acids via the corresponding nitriles and hydrogenation thereof.

The alkyl-substituted alkylene diamines suitable for use as component (b) correspond to the following formula $$R-\underset{\underset{HN-(CH_2)_n-NH_2}{|}}{CH}-R' \quad (V)$$

in which R and R' represent saturated or unsaturated, straight-chain or branched alkyl groups, which together contain from 7 to 22 carbon atoms, and n is an integer of from 2 to 4. The production of these compounds and their use in flotation is described in East German Pat. No. 64,275.

The hydroxyalkyl-substituted alkylene diamines suitable for use as component (b) correspond to the following formula $$R^1-\underset{\underset{HO}{|}}{CH}-\underset{\underset{NH-(CH_2)_n-NH_2}{|}}{CH}-R^2 \quad (VI)$$

in which $R^1$ and $R^2$ represent hydrogen and/or unbranched $C_1$–$C_{18}$ alkyl groups, the sum of the carbon atoms in $R^1$ and $R^2$ being from 9 to 18, and n is an integer of from 2 to 4. The production of the compounds corresponding to formula VI and their use in flotation is described in German Offenlegungsschrift No. 25 47 987.

The amine compounds discussed above may be used either as such or in the form of their water-soluble acid addition salts. The salts are obtained by neutralization which may be carried out both with equimolar quantities and also with an excess or submolar quantity of acid. Suitable acids are, for example, sulfuric acid, phosphoric acid, hydrochloric acid, acetic acid and formic acid.

The ampholytic surfactants which can be used as component (b) in accordance with the invention are compounds which contain at least one anion-active and one cation-active group in the molecule, the anion-active groups preferably being sulfonic acid or carboxyl groups and the cation-active groups being amino groups, preferably secondary or tertiary amino groups. Particularly suitable ampholytic surfactants are sarcosides, taurides, N-substituted amino-propionic acids and N-(1,2-dicarboxyethyl)-N-alkyl sulfosuccinamates.

The sarcosides suitable for use as component (b) correspond to the following formula $$R-CO-\underset{\underset{CH_3}{|}}{\overset{\oplus}{N}H}-CH_2-COO^{\ominus} \quad (VII)$$

in which is a $C_7$–$C_{21}$ alkyl group and preferably a $C_{11}$–$C_{17}$ alkyl group. These sarcosides are known compounds which may by obtained by known methods. For their use in flotation, see H. Schubert, Aufbereitung fester mineralischer Rohstoffe, 2nd Edition, Leipzig 1977, pp. 310–311, and the literature cited therein.

The taurides suitable for use as component (b) correspond to the following formula $$R-CO-\underset{\underset{CH_3}{|}}{\overset{\oplus}{N}H}-CH_2-CH_2-SO_3^{\ominus} \quad (VIII)$$

in which R is a $C_7$–$C_{21}$ alkyl group and preferably a $C_{11}$–$C_{17}$ alkyl group. These taurides are known compounds which may be obtained by known methods. The use of taurides in flotation is known, see H. Schubert referred to above.

N-substituted aminopropionic acids suitable for use as component (b) correspond to the following formula $$R-(NH-CH_2-CH_2)_n-NH_2^{\oplus}-CH_2CH_2-COO^{\ominus} \quad (IX)$$

in which n is 0 or a number of from 1 to 4 and R is an alkyl or acyl group containing from 8 to 22 and preferably from 12 to 18 carbon atoms. The N-substituted aminopropionic acids mentioned are also known compounds obtainable by known methods. For their use as collectors in flotation, see the above reference H. Schubert and Int. J. Min. Proc. 9 (1982), pp. 353–384, more especially p. 380.

The N-(1,2-dicarboxyethyl)-N-alkyl sulfosuccinamates suitable for use as component (b) in the collector mixtures according to the invention correspond to the following formula

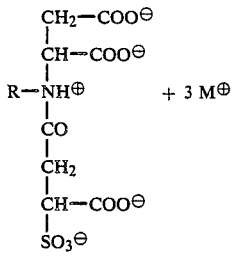

(X)

in which R is an alkyl group containing from 8 to 22 carbon atoms and, preferably, from 12 to 18 carbon atoms, and $M^{\oplus}$ is a hydrogen ion, an alkali metal cation, e.g. sodium, potassium, lithium, etc., or an ammonium ion, preferably a sodium ion. The N-(1,2-dicarboxyethyl)-N-alkyl sulfosuccinamates are known compounds which may be obtained by known methods. The use of these compounds as collectors in flotation is also known; see H. Schubert, supra.

The ratio by weight of components (a) to (b) in the mixtures of surfactants used in accordance with the invention is in the range of from 1:19 to 3:1 and, preferably, in the range of from 1:4 to 1:1.

The quantities in which the collector mixtures employed in accordance with the invention are used are determined by the type of ores to be floated and by their content of valuable minerals. Accordingly, the particular quantities necessary may vary within wide limits. In general, the collector mixtures according to the invention are used in quantities of from 20 to 2000 g per metric ton of crude ore.

The collector activity of the surfactant mixtures used in accordance with the invention is virtually unaffected by the hardness of the water used for preparing the pulps.

In practice, the mixtures of primary collectors and co-collectors used in accordance with the invention are used instead of the known anionic, cationic and/or ampholytic collectors in the known flotation processes for non-sulfidic ores. Accordingly, the particular reagents commonly used, such for example as frothers, regulators, activators, deactivators and the like, are added to the aqueous suspensions of the ground ores in addition to the collector mixtures. Flotation is carried out under the same conditions as state-of-the-art processes. In this connection, reference is made to the following literature references on ore preparation technology: H. Schubert, Aufbereitung fester mineralischer Rohstoffe, Leipzig 1967; B. Wills, Mineral Processing Technology Plant Design, New York, 1978; D. B. Purchas (ed.), Solid/Liquid Separation Equipment Scale-up, Croydon 1977; E. S. Perry, C. J. van Oss, E. Grushka (ed.), Separation and Purification Methods, New York 1973–1978.

The collector mixtures in accordance with the invention may be used, for example, in the flotation of apatite, scheelite and wolframite ores, in the separation of fluorite from quartz, in the separation of quartz or alkali silicates from hematite, magnetite and chromite by inverse flotation, in the separation of cassiterite from quartz and silicates and in the separation of oxides of iron and titanium from quartz for the purification of vitreous sands.

The present invention also relates to a process for the separation of non-sulfidic minerals from an ore by flotation, in which ground ore is mixed with water to form an ore suspension, air is introduced into the resulting suspension in the presence of the surfactant mixtures of the present invention as collector, and the froth formed is stripped together with the mineral therein.

The following Examples are intended to demonstrate the superiority of the collector mixtures used in accordance with the invention. The tests were carried out under laboratory conditions, in some cases with increased collector concentrations considerably higher than necessary in practice. Accordingly, the potential applications and in-use conditions are not limited to the separation exercises and test conditions described in the Examples. All percentages are percentages by weight, unless otherwise indicated. The quantities indicated for reagents are all based on active substance.

EXAMPLES 1 TO 8

The material to be floated consisted of an apatite ore from the South African Phalaborawa Complex which contains the following minerals as its principal constituents:

39% magnetite
11% carbonates
9% olivine
14% phlogopite
18% apatite

The $P_2O_5$-content of the ore was 6.4%. The flotation batch had the following particle size distribution:

18% <25 μm
34% 25–100 μm
43% 100–200 μm
5% >200 μm

The following compounds or mixtures were used as collectors (pbw=parts by weight):

Collector A 2.00 pbw technical oleic acid (saturated: 1% $C_{12}$; 3% $C_{14}$; 0.5% $C_{15}$; 5% $C_{16}$; 1% $C_{17}$; 2% $C_{18}$; monounsaturated: 6% $C_{16}$; 70% $C_{18}$; diunsaturated: 10% $C_{18}$; tri-unsaturated: 0.5% $C_{12}$; acid number 199–204; saponification number 200–205; iodine number 86–96)

1.00 pbw adduct of 2 moles ethylene oxide and 4 moles propylene oxide with 1 mole technical lauryl alcohol (0–3% $C_{10}$; 48–58 $C_{12}$; 19–24% $C_{14}$; 9–12% $C_{16}$; 10–13% $C_{18}$; acid number 0; hydroxyl number 265–275; saponification number 1.2; iodine number 0.5)

Collector B (comparison)

Technical oleic acid (composition and characteristics as for collector A)

Collector C 2.00 pbw sodium/ammonium salt (molar ratio $Na^+:NH_4^{30}=1:1$) of a monoalkyl sulfosuccinate of which the alkyl group is derived from a technical oleylcetyl alcohol (2% $C_{12}$; 3–8% $C_{14}$; 27–36% $C_{16}$; 58–68% $C_{18}$; 0–2% $C_{20}$; acid number 0.5; hydroxyl number 210–225; saponification number 2; iodine number 48–55).

1.0 pbw adduct of 2 moles ethylene oxide and 4 moles propylene oxide with 1 mole technical lauryl alcohol (see collector A)

Collector D 2.00 pbw sodium/ammonium salt of a monoalkyl sulfosuccinate (see collector C)

1.00 pbw adduct of 2 moles ethylene oxide and 4 moles propylene oxide with 1 mole isotridecanol Collector E (comparison)

Sodium/ammonium salt of a monoalkyl sulfosuccinate (see collector C).

Collector F (comparison)

2.00 pbw sodium/ammonium salt of a monoalkyl sulfosuccinate (see collector C).

1.00 pbw adduct of 5 moles propylene oxide with 1 mole 2-ethyl hexanol.

Collector G 2.00 pbw acetate of N-(2-hydroxy-$C_{11}$-$C_{14}$-alkyl-)ethylene diamine obtained by reaction of a 1,2-epoxy-$C_{11}$-$C_{14}$-alkane (chain length distribution: 22% $C_{11}$; 30% $C_{12}$; 26% $C_{13}$; 22% $C_{14}$) with ethylene diamine and subsequent neutralization with glacial acetic acid.

1.00 pbw adduct of 2 moles ethylene oxide and 4 moles propylene oxide with 1 mole technical lauryl alcohol (see collector A).

Collector H 2.00 pbw acetate of an N-(2-hydroxy-$C_{11}$-$C_{14}$-alkyl-)ethylene diamine (see collector G)

1.00 pbw adduct of 2 moles ethylene oxide and 4 moles propylene oxide with 1 mole isotridecanol.

The flotation tests were carried out in a laboratory flotation cell (Denver Equipment Model D-1, capacity 1.2 liters) at 20° C. In Examples 1 to 6, tapwater having a hardness of 18° dH (dH=German hardness) was used for preparing the pulps. In Examples 4 and 6, the pulps were prepared with hard water (945 ppm $Ca^{2+}$ and 1700 ppm $Mg^{2+}$). After the ore had been suspended in the flotation cell, the magnetite was removed with a hand magnet, washed and the wash water returned to the cell. The pulp density was 500 g/l. Waterglass was used as depressor in quantities of 1000 and 2000 g/t. The pH-value of the pulps was adjusted to 11 in each case. Flotation was carried out at a rotational speed of the mixer of 1500 r.p.m. The flotation time was 6 minutes. After rougher flotation, the concentrate was purified twice, collectors being introduced for the first purifying flotation in Examples 3 and 7.

In Table I below, the paticular collectors and the quantities in which they are used are shown in column 2. The quantity of waterglass used as depressor is shown in column 3. In column 4, "Magn." stands for magnetic separation, "R.F." for rougher flotation, "P.F." for purifying flotation and "conc." for concentrate. Column 5 shows the total recovery of the particular flotation step, based on total ore, column 6 shows the $P_2O_5$ content of the waste in the particular process step and column 7 shows the proportion of $P_2O_5$ recovered in each process step out of the total of $P_2O_5$ formed in the ore.

TABLE 1

| | | | Recovery of apatite (S. Africa) | | | |
|---|---|---|---|---|---|---|
| Example | Collector (g/t) | Depressor (g/t) | Flot. stage | Recovery (%) | $P_2O_5$ (%) | $P_2O_5$-recovery (%) |
| 1 | A 600 | 1000 | Magn. | 25.8 | 0.6 | 2 |
| | | | R.F. | 32.2 | 2.7 | 14 |
| | | | P.F. | 10.7 | 3.1 | 5 |
| | | | Conc. | 31.3 | 16.1 | 79 |
| 2 | B* 1000 | 2000 | Magn. | 30.6 | 2.7 | 13 |
| | | | R.F. | 45.3 | 4.2 | 30 |
| | | | P.F. | 7.5 | 5.1 | 6 |
| | | | Conc. | 16.6 | 19.9 | 51 |
| 3 | C 600 + 50 | 2000 | Magn. | 25.8 | 1.7 | 7 |
| | | | R.F. | 35.3 | 0.4 | 2 |
| | | | 1st P.F. | 10.0 | 3.1 | 5 |
| | | | 2nd P.F. | 5.5 | 4.3 | 4 |
| | | | Conc. | 23.4 | 22.5 | 82 |
| 4 | D 750 + 50 | 2000 | Magn. | 30.4 | 2.6 | 12 |
| | | | R.F. | 32.2 | 0.4 | 2 |
| | | | 1st P.F. | 9.9 | 3.8 | 6 |
| | | | 2nd P.F. | 5.9 | 4.5 | 4 |
| | | | Conc. | 21.6 | 22.4 | 76 |
| 5 | E 550 | 1000 | Magn. | 26.7 | 1.7 | 7 |
| | | | R.F. | 57.8 | 7.4 | 67 |
| | | | 1st P.F. | 11.5 | 10.5 | 19 |
| | | | 2nd P.F. | 2.7 | 11.7 | 5 |
| | | | Conc. | 1.3 | 10.4 | 2 |
| 6* | F 600 | 2000 | Magn. | 30.2 | 2.6 | 12 |
| | | | R.F. | 27.1 | 3.9 | 16 |
| | | | 1st P.F. | 21.6 | 9.1 | 31 |
| | | | 2nd P.F. | 5.6 | 6.5 | 7 |
| | | | Conc. | 15.5 | 14.2 | 34 |
| 7 | G 600 + 50 | 2000 | Magn. | 31.6 | 2.3 | 11 |
| | | | R.F. | 28.8 | 0.2 | 1 |
| | | | 1st P.F. | 8.1 | 1.4 | 2 |
| | | | 2nd P.F. | 4.5 | 3.3 | 2 |
| | | | Conc. | 27.0 | 19.8 | 84 |
| 8 | H 600 | 2000 | Magn. | 31.0 | | 15 |
| | | | R.F. | 32.6 | 0.3 | 1 |
| | | | 1st P.F. | 5.4 | 1.4 | 1 |
| | | | 2nd P.F. | 3.2 | 3.2 | 2 |
| | | | Conc. | 27.8 | 18.7 | 81 |

*Comparison tests

EXAMPLES 9 AND 10

The ore to be floated consisted of an apatite ore from Brazil containing ca. 20% apatite, ca. 35% magnetite, limonite and hematite and ca. 16% calcite. The $P_2O_5$-content of the ore was ca. 22%. The flotation batch had the following particle size distribution:

21% <25 μm
38% 40–100 μm
35% 100–250 μm
6% >250 μm

The following collectors were used:

Collector I
1.00 pbw sodium salt of a sulfosuccinamate derived from tallowamine
1.00 pbw adduct of 2 moles ethylene oxide and 4 moles propylene oxide with 1 mole technical lauryl alcohol (see collector A)

Collector J (comparison)
sodium salt of a sulfosuccinamate derived from tallowamine The flotation tests were carried out under the same conditions as in Examples 1 to 8 with the following modifications: starch was used as depressor. The pH-value of the pulps was 10.5. The pulps were prepared using tap-water having a hardness of 18° dH. The iron oxides were removed by magnetic separation before flotation of the apatite.

The results obtained are shown in Table II below in which the results of the 1st and 2nd purifying flotation are combined, but to which the explanations of Table I otherwise apply accordingly.

TABLE II

| | | | Flotation of apatite (Brazil) | | | |
|---|---|---|---|---|---|---|
| Example | Collector (g/t) | Depressor (g/t) | Flot. stage | Recovery (%) | $P_2O_5$ (%) | $P_2O_5$-recovery (%) |
| 9 | I | 600 | R.F. | 29.5 | 2.0 | 3 |
| | 420 | | P.F. | 9.1 | 2.7 | 1 |
| | | | Conc. | 61.4 | 34.6 | 96 |
| 10* | J | 600 | R.F. | 60.3 | 11.7 | 32 |
| | 440 | | P.F. | 7.6 | 28.1 | 10 |
| | | | Conc. | 32.1 | 39.6 | 58 |

*Comparison test

EXAMPLES 11–26

The material to be floated was a scheelite ore from Austria having the following chemical composition, based on its principal constituents:

$WO_3$ 0.4%
CaO 6.8%
$SiO_2$ 59.5%
$Fe_2O_3$ 7.0%
$Al_2O_3$ 12.1%
MgO 5.7%

The flotation batch had the following particle size distribution:

28% <25 μm
43% 25–100 μm
29% 100–200 μm

All the collector mixtures used contained as component (b) used in accordance with the invention a sodium/ammonium salt (molar ratio $Na^{30}:NH_4=1:1$) of a monoalkylsulfosuccinate of which the alkyl group is derived from a technical oleyl-cetyl alcohol (2% $C_{12}$; 3–8% $C_{14}$; 27–36% $C_{18}$; 0–2% $C_{20}$; acid number 0.5; hydroxyl number 210–225; saponification number 2; iodine number 48–55) referred to as collector A′ in the following Table).

The following adducts of ethylene oxide and propylene oxide with a technical lauryl alcohol (0–3% $C_{10}$; 48–58% $C_{12}$; 19–24% $C_{14}$; 9–12% $C_{16}$; 10–13% $C_{18}$; acid number 0; hydroxyl number 265–275; saponification number 1.2; iodine number 0.5) were used as component (a) in accordance with the invention:

an adduct of 2 moles ethylene oxide and 4 moles propylene oxide with 1 mole fatty alcohol (co-collector A″ in Table III below)

an adduct of 2.5 moles ethylene oxide and 6 moles propylene oxide with 1 mole fatty alcohol (co-collector B″)

an adduct of 4 moles ethylene oxide and 5 moles propylene oxide with 1 mole fatty alcohol (co-collector C″).

The comparison composition used in Example 22 contained as component (a) an adduct of 5 moles ethylene oxide with 1 mole nonylphenol (co-collector D″).

The flotation tests were carried out in a modified Hallimond tube (microflotation cell) according to B. Dobias, Colloid & Polymer Sci. 259 (1981), pp. 775–776 at a temperature of 23° C. Each test was carried out with 2 g ore. Distilled water was used to prepare the pulp. Collector and co-collector were added to the pulps in such quantities that a total collector quantity of 500 g/l was present. The conditioning time was 15 minutes in each test. During flotation, an air stream was passed through the pulp at a rate of 4 ml/min. In every test, the flotation time was 2 minutes.

The results obtained are set out in Table III below. Columns 2 and 3 show the collectors and co-collectors used and column 4 their ratios by weight. Column 5 shows the total recovery, based on the total quantity of ore, and column 6 the recovery of metal, based on the total quantity of $WO_3$ in the ore. The $WO_3$, CaO and $SiO_2$ contents of the concentrates are shown in columns 7, 8 and 9, respectively.

TABLE III

| | | | Flotation of scheelite | | | | | |
|---|---|---|---|---|---|---|---|---|
| | Collector | Co-collector | Ratio | Total recovery | Metal recovery | Concentrate content (%) | | |
| Example | (a) | (b) | (a):(b) | (%) | (%) | $WO_3$ | CaO | $SiO_2$ |
| 11 | A′ | A″ | 2:1 | 10.3 | 49 | 1.9 | 11.9 | 48.1 |
| 12 | A′ | A″ | 1:1 | 7.7 | 44 | 2.3 | 12.3 | 47.0 |
| 13 | A′ | A″ | 1:2 | 12.4 | 40 | 1.3 | 10.4 | 50.0 |
| 14* | — | A″ | 0:1 | 4.9 | 7.3 | 0.6 | 7.6 | 52.5 |
| 15 | A′ | B″ | 2:1 | 9.7 | 44 | 1.8 | 12.3 | 49.1 |
| 16 | A′ | B″ | 1:1 | 15.8 | 51 | 1.3 | 10.1 | 51.0 |
| 17* | | B″ | 0:1 | 4.6 | 8.5 | 0.7 | 8.4 | 55.4 |
| 18 | A′ | C″ | 2:1 | 10.1 | 45 | 1.8 | 12.1 | 48.9 |
| 19 | A′ | C′ | 1:1 | 13.4 | 47 | 1.4 | 10.6 | 50.1 |
| 20 | A′ | C″ | 1:2 | 10.1 | 48 | 1.9 | 11.9 | 50.5 |
| 21* | — | C″ | 0:1 | 4.6 | 7.5 | 0.6 | 7.8 | 52.7 |
| 22* | A′ | D″ | 1:1 | 8.7 | 39 | 1.8 | 11.5 | 47.7 |

EXAMPLES 27–31

The material to be floated consisted of a kaolinite ore from the Oberpfalz containing 55.1% clay and 44.9% feldspar. The flotation batch had the following particle size distribution:

64% <25 μm
22% 25–40 μm
14% >40 μm

The following substances or mixtures of substances were used as collectors:

Collector K
3.00 pbw commercial sodium alkylbenzenesulfonate of which the alkyl groups contain 12–16 carbon atoms, predominantly 12 carbon atoms,
1.00 pbw adduct of 2 moles ethylene oxide and 4 moles propylene oxide with 1 mole commercial lauryl alcohol (see collector A)

Collector L
2.00 pbw commercial alkylbenzene sulfonate (see collector I)
1.00 pbw adduct of 2 moles ethylene oxide and 4 moles propylene oxide with 1 mole commercial lauryl alcohol (see collector A)

Collector M
1.00 pbw commercial alkylbenzenesulfonate (see collector I)
1.00 pbw adduct of 2 moles ethylene oxide and 4 moles propylene oxide with 1 mole commercial lauryl alcohol (see collector A)

Collector N
2.00 pbw N-β-hydroxy-$C_{12}$–$C_{14}$-alkylethylenediamine formate prepared by reaction of a linear α-$C_{12}$–$C_{14}$-epoxy-alkane with ethylenediamine and subsequent neutralization with formic acid
1.00 pbw adduct of 2 moles ethylene oxide and 4 moles propylene oxide with 1 mole commercial lauryl alcohol (see collector A)

Collector O (comparison)
commercial alkylbenzenesulfonate (see collector I)

The flotation tests were carried out in a Humbold-Wedag laboratory flotation machine (KHD Industrieanlagen AG, Humbold-Wedag, Cologne; see Seifen-Fette-Wachse 105 (1979), p. 248) using a 1 liter flotation cell. Tapwater having a hardness of 18° dH was used for preparing the pulps. The pulp density was 250 g/l. Aluminium sulfate in a quantity of 500 g/t was used as activator. The pH-value was adjusted to 3 with sulfuric acid. The conditioning time was 10 minutes. Flotation was carried out for 15 minutes at 23° C. at a rotational speed of the rotor of 1200 r.p.m. The collector was added to the pulps in 3 or 4 portions as shown in Table IV below.

The results obtained are shown in Table IV to which the explanations of Table I apply accordingly.

TABLE IV

| Example | Collector type/quantity (g/t) | | Flotation of kaolinite: Flot. stage | Recovery (%) | Clay (%) | Metal recovery (%) |
|---|---|---|---|---|---|---|
| 23 | K | 400 | Conc. 1 | 31.4 | 80.9 | 46 |
| | | 200 | Conc. 2 | 16.7 | 74.5 | 23 |
| | | 200 | Conc. 3 | 10.3 | 73.8 | 14 |
| | | 100 | Conc. 4 | 3.1 | 64.8 | 4 |
| | | 900 | | 62.9 | 75.4 | 87 |
| | | | Waste | 37.1 | 20.7 | 13 |
| 24 | L | 400 | Conc. 1 | 27.5 | 86.8 | 43 |
| | | 200 | Conc. 2 | 15.4 | 85.2 | 24 |
| | | 200 | Conc. 3 | 10.6 | 75.9 | 15 |

TABLE IV-continued

| Example | Collector type/quantity (g/t) | | Flotation of kaolinite: Flot. stage | Recovery (%) | Clay (%) | Metal recovery (%) |
|---|---|---|---|---|---|---|
| | | 100 | Conc. 4 | 4.2 | 70.4 | 5 |
| | | 900 | | 57.7 | 83.4 | 87 |
| | | | Waste | 42.3 | 21.1 | 13 |
| 25 | M | 400 | Conc. 1 | 22.7 | 84.9 | 35 |
| | | 200 | Conc. 2 | 15.4 | 82.1 | 23 |
| | | 200 | Conc. 3 | 10.9 | 71.9 | 14 |
| | | 100 | Conc. 4 | 4.8 | 67.1 | 6 |
| | | 900 | | 53.8 | 79.9 | 78 |
| | | | Waste | 46.2 | 22.5 | 22 |
| 26 | N | 400 | Conc. 1 | 33.4 | 84.9 | 51 |
| | | 200 | Conc. 2 | 20.0 | 77.7 | 28 |
| | | 200 | Conc. 3 | 11.5 | 55.0 | 11 |
| | | 800 | | 64.9 | 77.4 | 90 |
| | | | Waste | 35.1 | 12.3 | 10 |
| 27* | O | 400 | Conc. 1 | 44.5 | 78.9 | 63 |
| | | 200 | Conc. 2 | 13.0 | 70.2 | 17 |
| | | 200 | Conc. 3 | 8.0 | 63.3 | 9 |
| | | 100 | Conc. 4 | 2.5 | 54.7 | 3 |
| | | 900 | | 68.0 | 75.5 | 92 |
| | | | Waste | 32.0 | 16.9 | 8 |

*Comparison test

We claim:

1. A process for separating non sulfidic minerals from an ore by flotation which comprises the steps of
   A. contacting the ore with a mineral collector-active quantity of a mixture of
      (a) at least one reaction adduct of ethylene oxide and propylene oxide with a $C_8$–$C_{22}$ fatty alcohol; and
      (b) at least one anionic, cationic or ampholytic surfactant, in the presence of water; and
   B. aerating the aqueous mixture from step A. to produce a foam containing the non-sulfidic mineral; and
   C. separating the foam from the aqueous mixture.

2. The process of claim 1, wherein component (a) comprises an adduct of m moles ethylene oxide and n moles propylene oxide with $C_8$–$C_{22}$ fatty alcohols, m and n each being a number of from 1 to 15, the sum of m plus n being from 2 to 25 and the ratio of m to n being from about 1:5 to about 2:1.

3. The process of claim 1, wherein component (a) comprises an adduct of ethylene oxide and propylene oxide with $C_{12}$–$C_{18}$ fatty alcohols.

4. The process of claim 1, wherein component (b) is at least one anionic surfactant selected from the group consisting of fatty acids, alkyl sulfates, alkyl sulfosuccinates, alkyl sulfosuccinamates, alkylbenzenesulfonates, alkyl sulfonates, petroleum sulfonates and acyl lactylates.

5. The process of claim 1, wherein component (b) is at least one cationic surfactant selected from the group consisting of primary aliphatic amines, alkylene diamines substituted by α-branched alkyl groups, hydroxyalkyl-substituted alkylene diamines and water-soluble acid addition salts of the above amines.

6. The process of claim 1, wherein component (b) is at least one ampholytic surfactant selected from the group consisting of sarcosides, taurides, N-substituted aminopropionic acids and N-(1,2-dicarboxyethyl)-N-alkylsulfosuccinamates.

7. The process of claim 1, wherein the ratio by weight of component (a) to component (b) in the mixture of components (a) and (b) is from about 1:19 to about 3:1.

8. The process of claim 1, wherein the ratio by weight of component (a) to component (b) in the mixture of components (a) and (b) is from about 1:4 to about 1:1.

9. The process of claim 1, wherein the mixture is used in a quantity of from about 20 to about 2000 g per ton of ore.

10. A process for the separation of non-sulfidic minerals from a ground ore by flotation comprising the steps of A. mixing the ground ore with water to form an ore suspension;

B. introducing into the suspension a mineral collector-active quantity of a mixture of (a) at least one reaction adduct of ethylene oxide and propylene oxide with a $C_8$–$C_{22}$ fatty alcohol and (b) at least one anionic, cationic or ampholytic surfactant;

C. aerating the suspension to produce a foam containing the non-sulfidic mineral; and D. separating the foam from the suspension.

11. The process of claim 10, wherein in step B. component (b) is at least one anionic surfactant selected from the group consisting of fatty acids, alkyl sulfates, alkyl sulfosuccinates, alkyl sulfosuccinamates, alkylbenzenesulfonates, alkyl sulfonates, petroleum sulfonates and acyl lactylates.

12. The process of claim 10, wherein in step B. component (b) is at least one cationic surfactant selected from the group consisting of primary aliphatic amines, alkylene diamines substituted by α-branched alkyl groups, hydroxyalkyl-substituted alkylene diamines and water-soluble acid addition salts of these amines.

13. The process of claim 10, wherein in step B. component (b) is at least one ampholytic surfactant selected from the group consisting of sarcosides, taurides, N-substituted aminopropionic acids and N-(1,2-dicarboxyethyl)-N-alkylsulfosuccinamates.

14. The process of claim 10, wherein in step B. the ratio by weight of component (a) to component (b) in the mixture of components (a) and (b) is from about 1:19 to about 3:1.

15. The process of claim 10, wherein in step B. the ratio by weight of component (a) to component (b) in the mixture of components (a) and (b) is from about 1:4 to about 1:1.

16. The process of claim 10, wherein in step B. the mixture is used in a quantity of from about 20 to about 2000 g per ton of ore.

* * * * *